US011506203B2

(12) United States Patent
Han et al.

(10) Patent No.: US 11,506,203 B2
(45) Date of Patent: Nov. 22, 2022

(54) PUMP BODY ASSEMBLY AND ASSEMBLY METHOD THEREFOR

(71) Applicant: GREE GREEN REFRIGERATION TECHNOLOGY CENTER CO., LTD. OF ZHUHAI, Guangdong (CN)

(72) Inventors: Xin Han, Guangdong (CN); Xumin Zhao, Guangdong (CN); Huiming Peng, Guangdong (CN); Luchen Bai, Guangdong (CN); Jilong Jin, Guangdong (CN); Yan Zhou, Guangdong (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 0 days.

(21) Appl. No.: 16/956,436

(22) PCT Filed: Jun. 15, 2018

(86) PCT No.: PCT/CN2018/091630
§ 371 (c)(1),
(2) Date: Jun. 19, 2020

(87) PCT Pub. No.: WO2019/119751
PCT Pub. Date: Jun. 27, 2019

(65) Prior Publication Data

US 2021/0131436 A1 May 6, 2021

(30) Foreign Application Priority Data

Dec. 20, 2017 (CN) ..... 201711410057.9

(51) Int. Cl.
*F03C 2/00* (2006.01)
*F03C 4/00* (2006.01)
(Continued)

(52) U.S. Cl.
CPC ..... *F04C 23/001* (2013.01); *F04C 18/3566* (2013.01); *F04C 2230/60* (2013.01)

(58) Field of Classification Search
CPC .. F04C 23/001; F04C 23/008; F04C 18/3564; F04C 18/3566; F04C 2230/60; F04C 2230/603
See application file for complete search history.

(56) References Cited

U.S. PATENT DOCUMENTS

2016/0018136 A1* 1/2016 Hirayama ..... F01C 21/02 417/410.3

FOREIGN PATENT DOCUMENTS

CN 201412350 B1 2/2010
CN 101397997 B 6/2010
(Continued)

OTHER PUBLICATIONS

CN106468261A—Ye et al.—Pump Body Structure, Compressor and Assembling Technology of Pump Body—Mar. 1, 2017—the machine English Translation. (Year: 2017).*
(Continued)

*Primary Examiner* — Theresa Trieu
(74) *Attorney, Agent, or Firm* — Perkins Coie LLP

(57) ABSTRACT

Provided are a pump body assembly and an assembly method therefor. The pump body assembly includes a first cylinder assembly (10), a second cylinder assembly (20) and a third cylinder assembly (30) sequentially arranged in a vertical direction. At least one of the first cylinder assembly (10), the second cylinder assembly (20) and the third cylinder assembly (30) is provided with a positioning detection portion (40).

13 Claims, 9 Drawing Sheets

(51) Int. Cl.

| | |
|---|---|
| ***F04C 2/00*** | (2006.01) |
| ***F04C 11/00*** | (2006.01) |
| ***F04C 23/00*** | (2006.01) |
| ***F04C 18/356*** | (2006.01) |

(56) References Cited

FOREIGN PATENT DOCUMENTS

| | | | |
|---|---|---|---|
| CN | 102121474 | A1 | 7/2011 |
| CN | 104047860 | A1 | 9/2014 |
| CN | 104842155 | A | 8/2015 |
| CN | 204877958 | B1 | 12/2015 |
| CN | 205013298 | B1 | 2/2016 |
| CN | 105683572 | B1 | 6/2016 |
| CN | 106468261 | B1 | 3/2017 |
| JP | 2008101557 | B1 | 5/2008 |
| JP | 2011064183 | A1 | 3/2011 |

OTHER PUBLICATIONS

JP2011-064183A—Yamazaki et al.—Multicylinder Rotary Compressor—Mar. 31, 2011—the Machine English Translation. (Year: 2011).*

International Search Report in the international application No. PCT/CN2018/091630, dated Aug. 17, 2018 (with translation) (6 pages).

Written Opinion of the International Searching Authority, in the international application No. PCT/CN2018/091630, dated Aug. 17, 2018 (with translation) (6 pages).

First Search Report and Office Action of Chinese Patent Application CN201711410057.9 (with translation) (10 pages).

* cited by examiner

PUMP BODY ASSEMBLY AND ASSEMBLY METHOD THEREFOR

CROSS-REFERENCE TO RELATED APPLICATIONS

The present application is a U.S. National Phase Entry of International PCT Application No. PCT/CN2018/091630 filed on Jun. 15, 2018, and entitled "PUMP BODY ASSEMBLY AND ASSEMBLY METHOD THEREFOR", which claims priority to Chinese Patent Application No. 201711410057.9, filed Dec. 20, 2017, the content of which is hereby incorporated by reference in their entirety.

TECHNICAL FIELD

The disclosure relates to the field of compressor equipment technologies, and more particularly, to a pump body assembly and an assembly method therefor.

BACKGROUND

When assembling a pump body assembly of an existing compressor, cylinders need to be centered to ensure that clearance fit between an outer circle of a rolling rotor and an inner circle of the cylinder can not only meet a smoothness of roller rotation but also reduce compression leakage. A present automatic assembly technology can only center an upper flange and an upper cylinder as well as a lower flange and a lower cylinder of a multi-cylinder compressor, while a clearance between a middle cylinder and the rolling rotor can only be adjusted manually, which cannot implement automatic assembly, is time-consuming and labor-consuming, and seriously affects a production efficiency.

SUMMARY

The disclosure is mainly intended to provide a pump body assembly and an assembly method therefor to solve the problem of low efficiency of the pump body assembly during assembly in the prior art.

In order to achieve the above object, according to one aspect of the disclosure, there is provided a pump body assembly, which includes a first cylinder assembly, a second cylinder assembly and a third cylinder assembly sequentially arranged in a vertical direction, wherein at least one of the first cylinder assembly, the second cylinder assembly and the third cylinder assembly is provided with a positioning detection portion, a geometric center line of the positioning detection portion in a radial direction of the pump body assembly has a preset included angle with an extension line from a sliding-vane groove in the first cylinder assembly, the second cylinder assembly or the third cylinder assembly to a geometric center of the pump body assembly, and the preset included angle is used for positioning the first cylinder assembly, the second cylinder assembly and the third cylinder assembly to implement automatic assembly of the pump body assembly.

Further, the positioning detection portion includes a first detection portion, the third cylinder assembly includes a lower flange; a third cylinder, the third cylinder being connected with the lower flange; and a lower cover plate, the lower cover plate being connected with the lower flange and located below the lower flange; and the first detection portion is arranged on one of the lower flange, the third cylinder and the lower cover plate.

Further, the first detection portion is a positioning hole, the positioning hole is arranged in an outer peripheral surface of the third cylinder, the third cylinder is provided with a third sliding-vane groove, and a geometric center line of the positioning hole in a radial direction of the third cylinder intersects with a geometric center line of the third sliding-vane groove in a radial direction of the third cylinder to form a preset included angle.

Further, two positioning holes are provided, and the preset included angle includes a first included angle and a second included angle, wherein the geometric center line of one of the two positioning holes in the radial direction of the third cylinder intersects with the geometric center line of the third sliding-vane groove in the radial direction of the third cylinder to form the first included angle, and the geometric center line of the other one of the two positioning holes in the radial direction of the third cylinder intersects with the geometric center line of the third sliding-vane groove in the radial direction of the third cylinder to form the second included angle.

Further, the first included angle is a, and the second included angle is β, Wherein $\alpha+\beta=90°$, $0<\alpha<120°$, and $-120<\beta<90°$.

Further, a roughness of an inner circle of the positioning hole is less than or equal to 1.6.

Further, the second cylinder assembly is provided with the positioning detection portion, the positioning detection portion further includes a second detection portion, the second cylinder assembly includes a second cylinder, the second detection portion is arranged on an outer peripheral surface of the second cylinder, and a projection of a geometric center line of the second detection portion in a radial direction of the second cylinder on a horizontal plane is overlapped with a projection of a geometric center line of the first detection portion in the radial direction of the third cylinder on the horizontal plane.

Further, the first cylinder assembly is provided with the positioning detection portion, the positioning detection portion further includes a third detection portion, the first cylinder assembly includes an upper flange; and a first cylinder, the first cylinder being connected with the upper flange and located below the upper flange; the third detection portion is arranged on an outer peripheral surface of the upper flange or the first cylinder, and a projection of a geometric center line of the third detection portion in a radial direction of the first cylinder on a horizontal plane is overlapped with a projection of a geometric center line of the first detection portion in the radial direction of the third cylinder on the horizontal plane.

Further, the positioning detection portion includes a first detection portion, a second detection portion and a third detection portion, the first detection portion is arranged on an outer peripheral surface of a third cylinder of the third cylinder assembly, the second detection portion is arranged on an outer peripheral surface of a second cylinder of the second cylinder assembly, the third detection portion is arranged on an outer peripheral surface of a first cylinder of the first cylinder assembly, and the first detection portion, the second detection portion and the third detection portion have a same structure.

According to another aspect of the disclosure, there is provided a method for assembling a pump body structure, wherein the method is used for assembling the pump body assembly, and includes the following steps of step S10: assembling the second cylinder assembly and the third cylinder assembly for the first time, and recording first assembly positions of the second cylinder assembly and the third cylinder assembly through the positioning detection portions arranged on the second cylinder assembly and the third cylinder assembly; step S20: disassembling the second cylinder assembly and the third cylinder assembly that are assembled, assembling a crankshaft of the pump body assembly with the second cylinder assembly and the third cylinder assembly for the second time, and recording second assembly positions of the second cylinder assembly and the third cylinder assembly through the positioning detection portions arranged on the second cylinder assembly and the third cylinder assembly; and step S30: adjusting a position of the second cylinder assembly according to a relationship between the first assembly position and the second assembly position until relative positions of the second cylinder assembly and the third cylinder assembly fall into preset assembly positions, and fixing the second cylinder assembly and the third cylinder assembly through a screw.

Further, the step S10 includes determining the first assembly positions through a positioning hole arranged in the second cylinder of the second cylinder assembly and a positioning hole arranged in the third cylinder of the third cylinder assembly, and/or the step S20 includes determining the second assembly positions through a positioning hole arranged in the second cylinder of the second cylinder assembly and a positioning hole arranged in the third cylinder of the third cylinder assembly.

Further, the step S10 includes determining the first assembly positions through a positioning hole arrange in the second cylinder of the second cylinder assembly and a positioning hole arranged in the lower flange of the third cylinder assembly, and/or the step S20 includes determining the second assembly positions through a positioning hole arranged in the second cylinder of the second cylinder assembly and a positioning hole arranged in the lower flange of the third cylinder assembly.

Further, the method further includes the following steps of step S40: when assembling the second cylinder assembly and the third cylinder assembly on the preset assembly positions, assembling the first cylinder assembly on the second cylinder assembly.

According to the technical solutions applied in the disclosure, the pump body assembly includes the first cylinder assembly, the second cylinder assembly and the third cylinder assembly sequentially arranged in the vertical direction, wherein at least one of the first cylinder assembly, the second cylinder assembly and the third cylinder assembly is provided with the positioning detection portion, the geometric center line of the positioning detection portion in the radial direction of the pump body assembly has the preset included angle with the extension line from the sliding-vane move in the first cylinder assembly, the second cylinder assembly or the third cylinder assembly to the geometric center of the pump body assembly, and the preset included angle is used for positioning the first cylinder assembly, the second cylinder assembly and the third cylinder assembly to implement the automatic assembly of the pump body assembly. At least one of the three vertically arranged cylinder assemblies is provided with the positioning detection portion, and the positioning detection portion is used as a reference for determining the position relationship among all cylinder assemblies, thus ensuring a centering accuracy of assembly of the pump body assembly.

BRIEF DESCRIPTION OF THE DRAWINGS

The drawings constructing a part of the disclosure are used for providing further understanding to the disclosure, and the illustrative embodiments of the disclosure and the descriptions thereof are used for explaining the disclosure and do not constitute an improper limitation on the disclosure. In the drawings.

Figure 1:
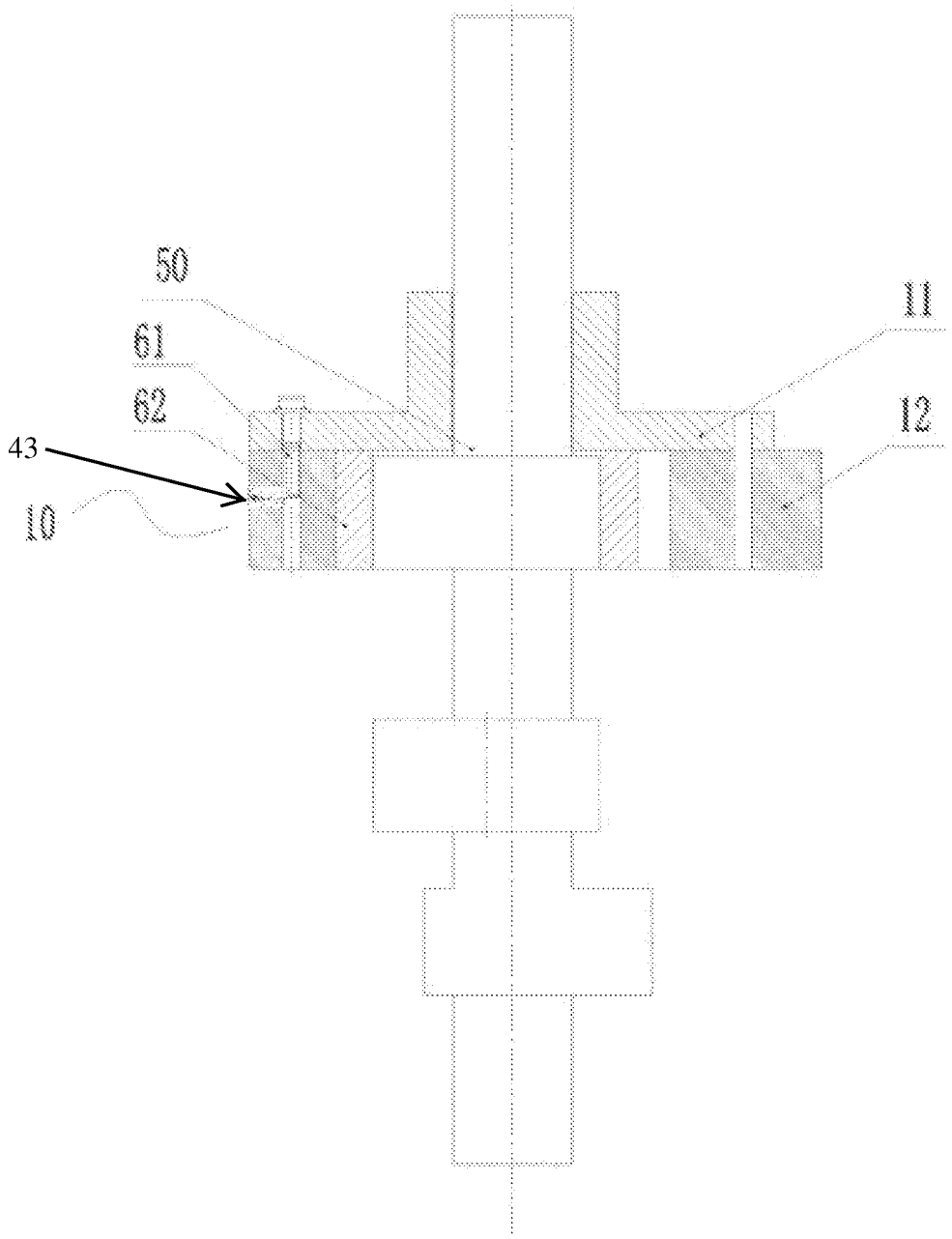
FIG. 1 shows a sectional structure diagram of an embodiment of a first cylinder assembly and a crankshaft according to the disclosure.

The above drawings include the following numerals:

10 refers to first cylinder assembly; 11 refers to upper flange; 12 refers to first cylinder;

20 refers to second cylinder assembly; 21 refers to second cylinder;

30 refers to third cylinder assembly; 31 refers to lower flange; 32 refers to third cylinder; 321 refers to third sliding-vane groove; 33 refers to lower cover plate;

40 refers to positioning detection portion; 41 refers to first detection portion; 42 refers to second detection portion; 43 refers to third detection portion;

50 refers to crankshaft; 61 refers to screw; 62 refers to upper roller; 63 refers to lower roller; 64 refers to lower partition plate; 65 refers to middle roller; 66 refers to middle partition plate; and 67 refers to upper partition plate.

DETAILED DESCRIPTION

It should be noted that, in case of no conflicts, the embodiments in the disclosure and the features in this embodiments can be combined with each other. The disclosure will be described in detail hereinafter with reference to the drawings and the embodiments.

With reference to FIG. 1 to FIG. 10, according to an embodiment of the disclosure, there is provided a pump body assembly Specifically, the pump body assembly includes a first cylinder assembly 10, a second cylinder assembly 20 and a third cylinder assembly 30 sequentially arranged in a vertical direction. At least one of the first cylinder assembly 10, the second cylinder assembly 20 and the third cylinder assembly 30 is provided with a positioning detection portion 40, a geometric center line of the positioning detection portion 40 in a radial direction of the pump body assembly has a preset included angle with an extension line from a third sliding-vane groove 321 in the first cylinder assembly 10, the second cylinder assembly 20 or the third cylinder assembly 30 to a geometric center of the pump body assembly, and the preset included angle is used for positioning the first cylinder assembly 10, the second cylinder assembly 20 and the third cylinder assembly 30 to implement automatic assembly of the pump body assembly.

In this embodiment, at least one of the three vertically arranged cylinder assemblies is provided with the positioning detection portion 40, and the positioning detection portion 40 is used as a reference for determining a position relationship among all flanges and cylinders, thus providing a basis for eccentric assembly of a cylinder and ensuring a centering accuracy of an assembly method of the pump body assembly.

Figure 2:
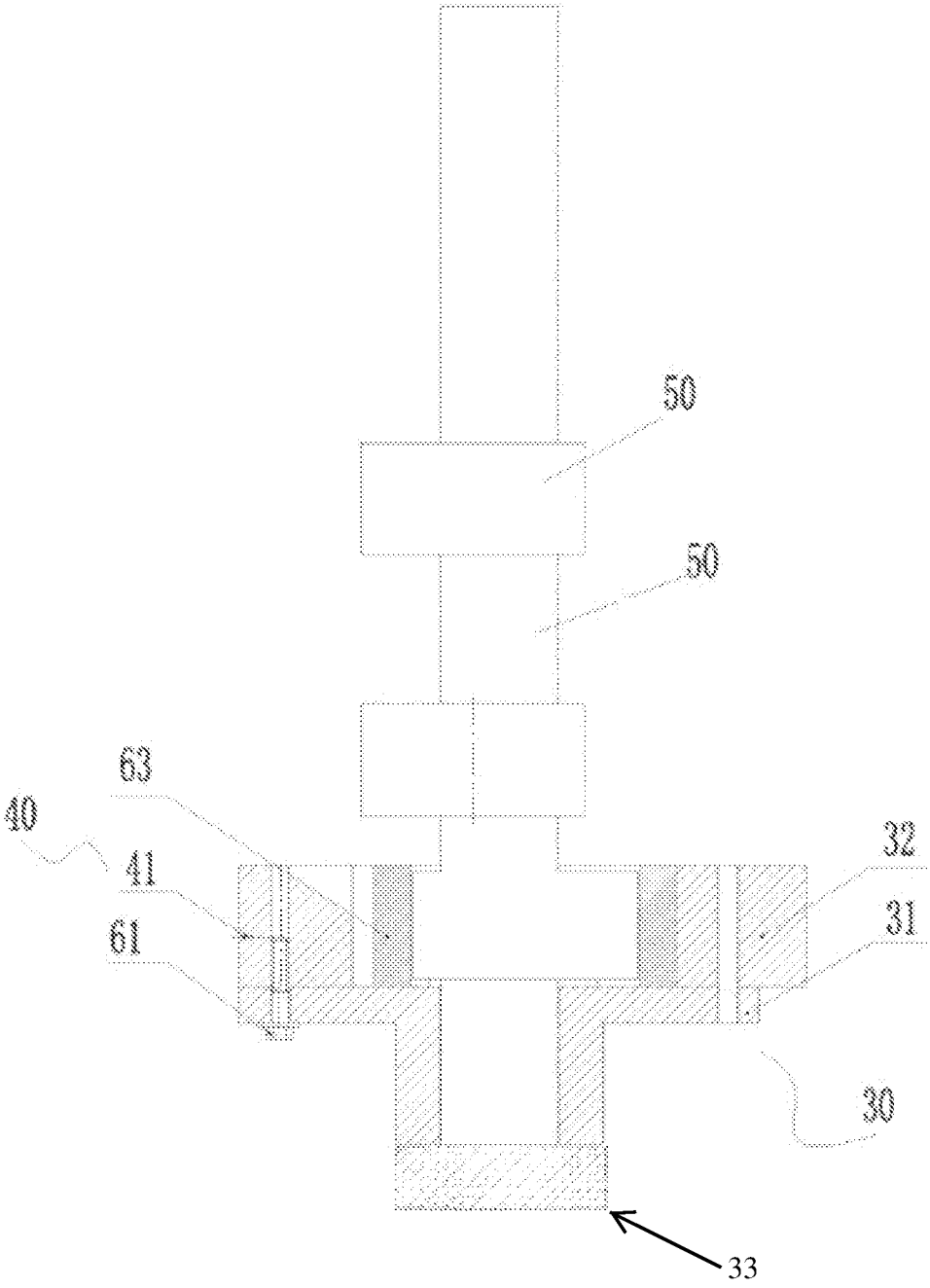
FIG. 2 shows a sectional structure diagram of an embodiment of a third cylinder assembly and a crankshaft according to the disclosure.
Figure 3:
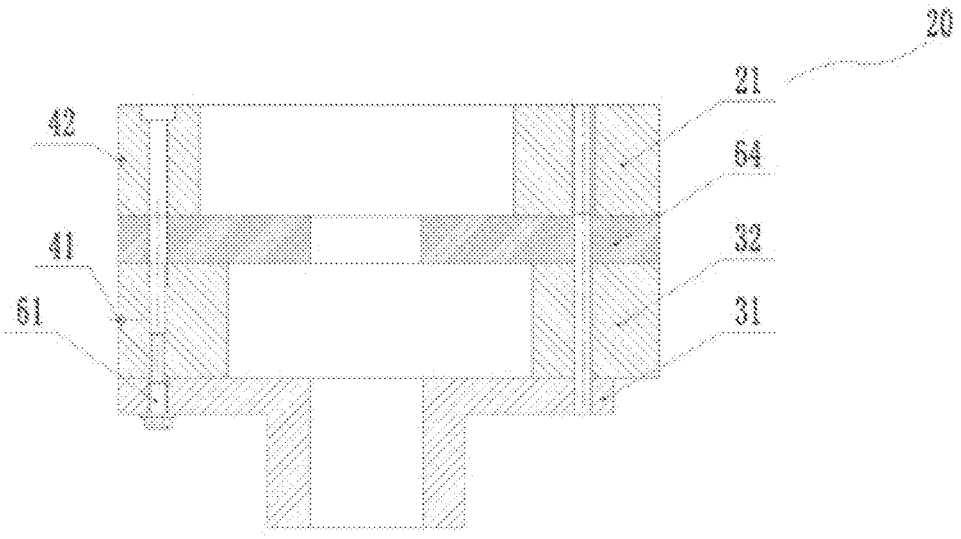
FIG. 3 shows a sectional structure diagram of an embodiment of a third cylinder assembly and a second cylinder assembly according to the disclosure.
Figure 4:
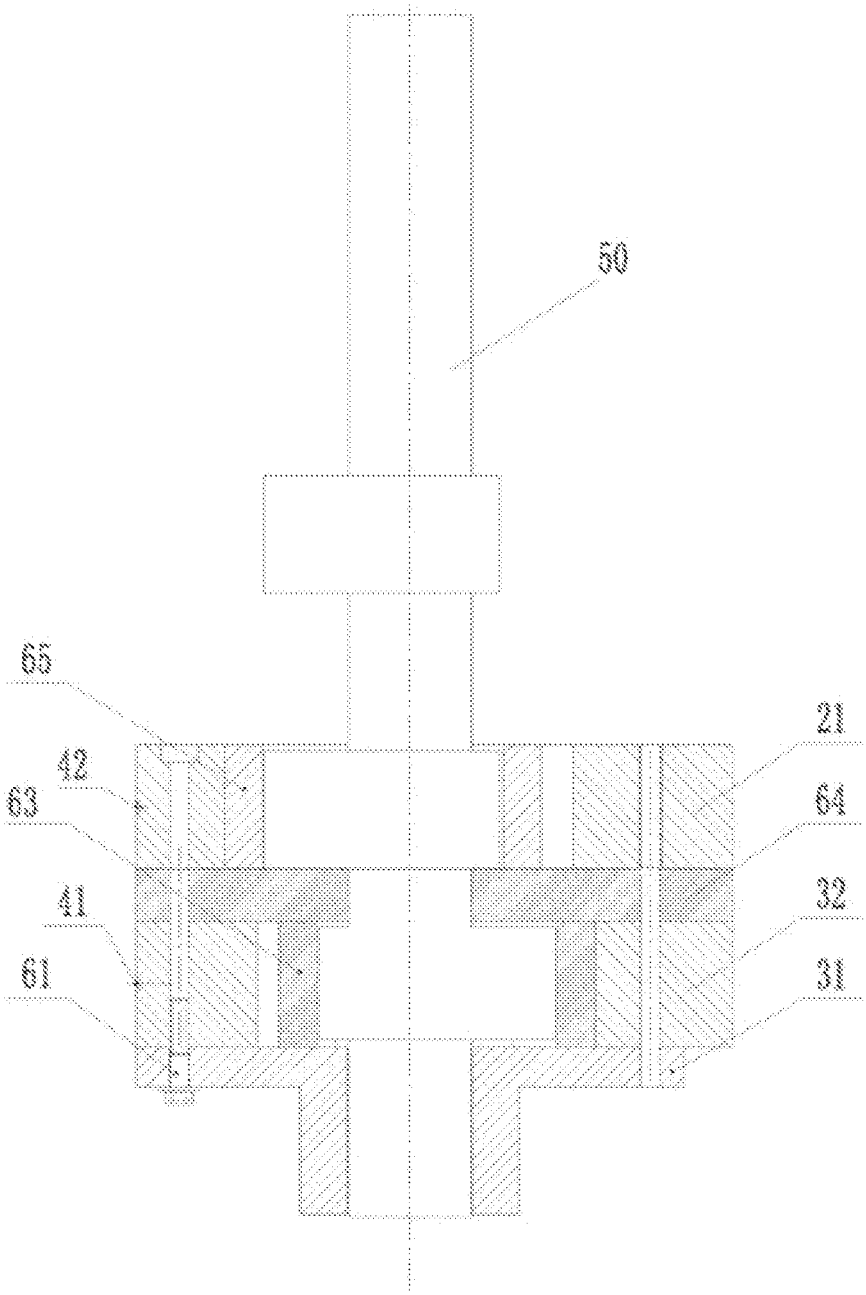
FIG. 4 shows a sectional structure diagram of an embodiment of a third cylinder assembly, a second cylinder assembly and a crankshaft according to the disclosure.
Figure 5:
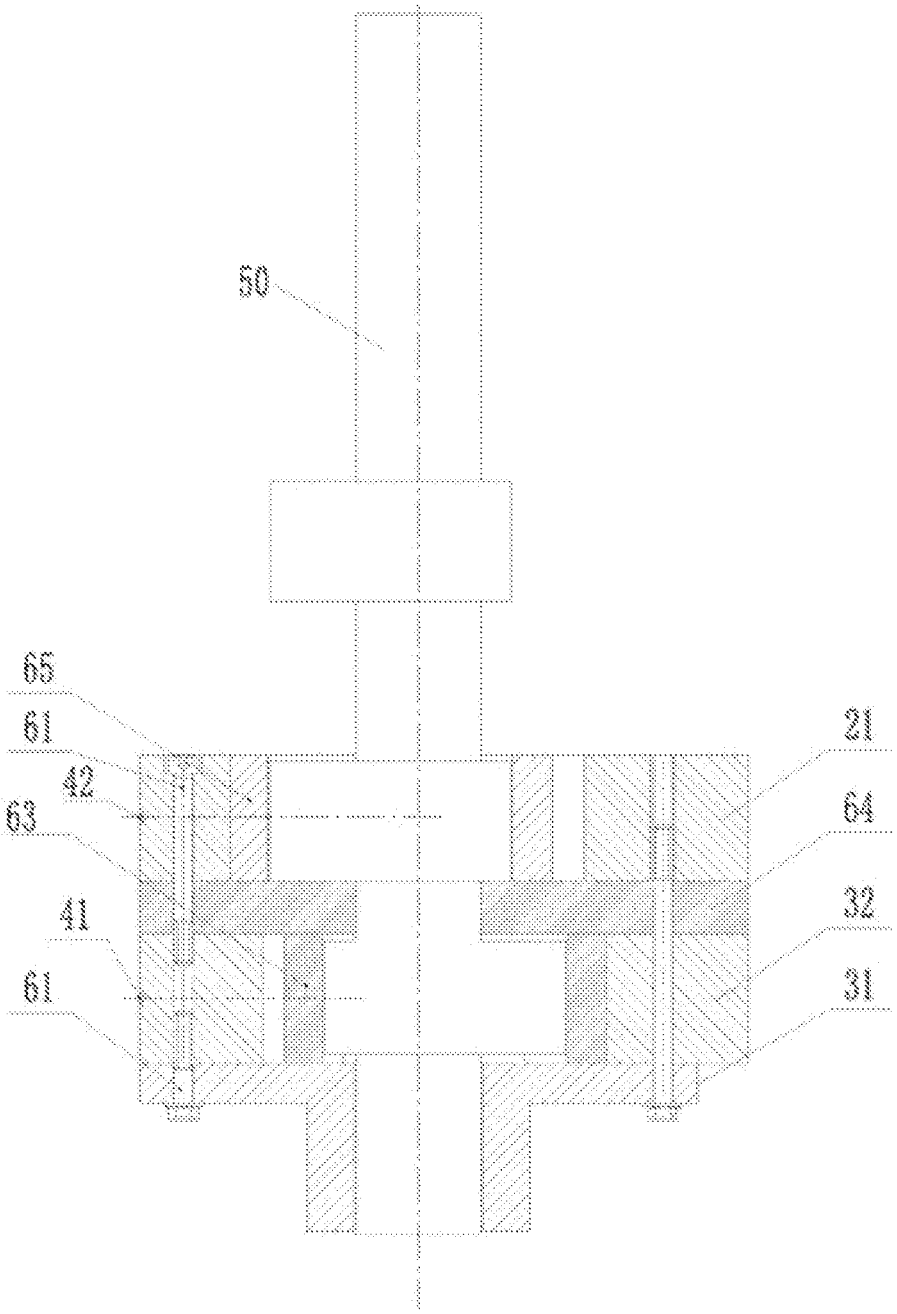
FIG. 5 shows a sectional structure diagram of an embodiment of assembling a third cylinder assembly, a second cylinder assembly and a crankshaft with a screw according to the disclosure.
Figure 6:
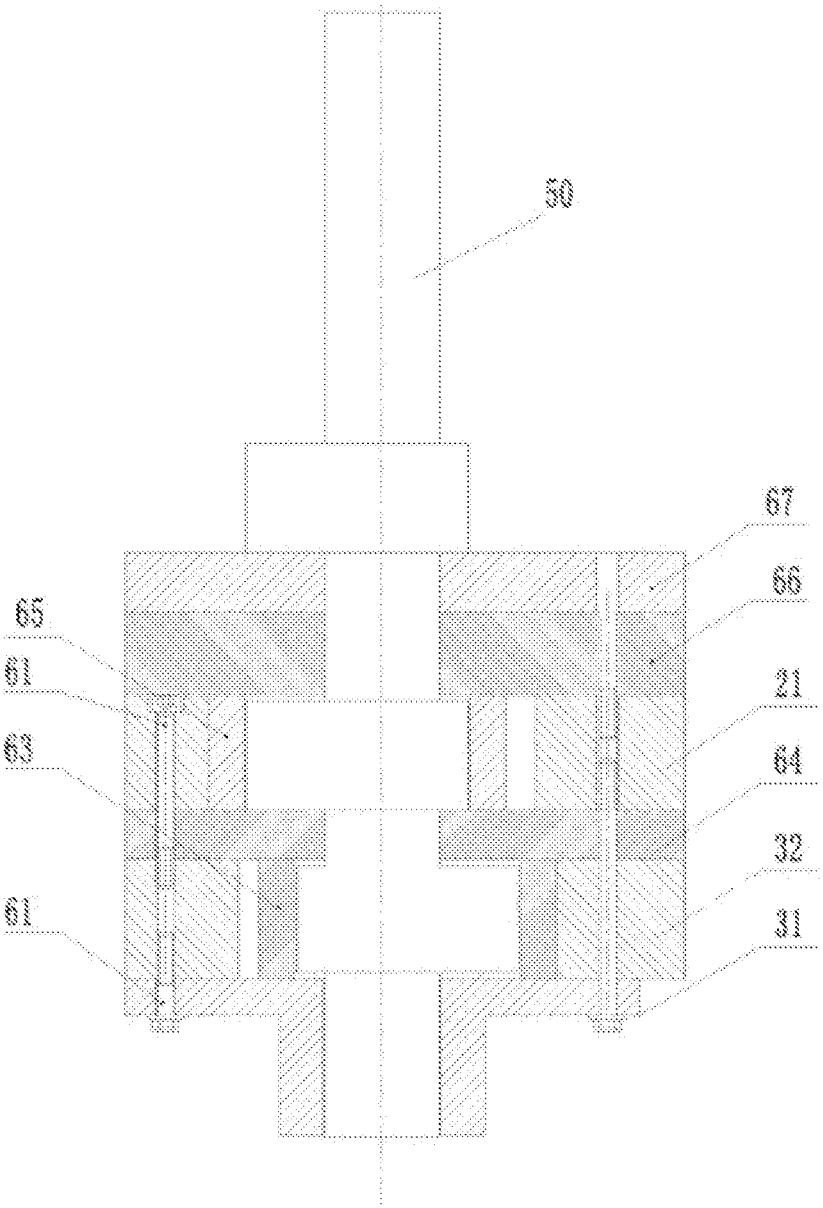
FIG. 6 shows a sectional structure diagram of an embodiment of assembling a third cylinder assembly, a second cylinder assembly and a crankshaft with a partition plate according to the disclosure.
Figure 7:
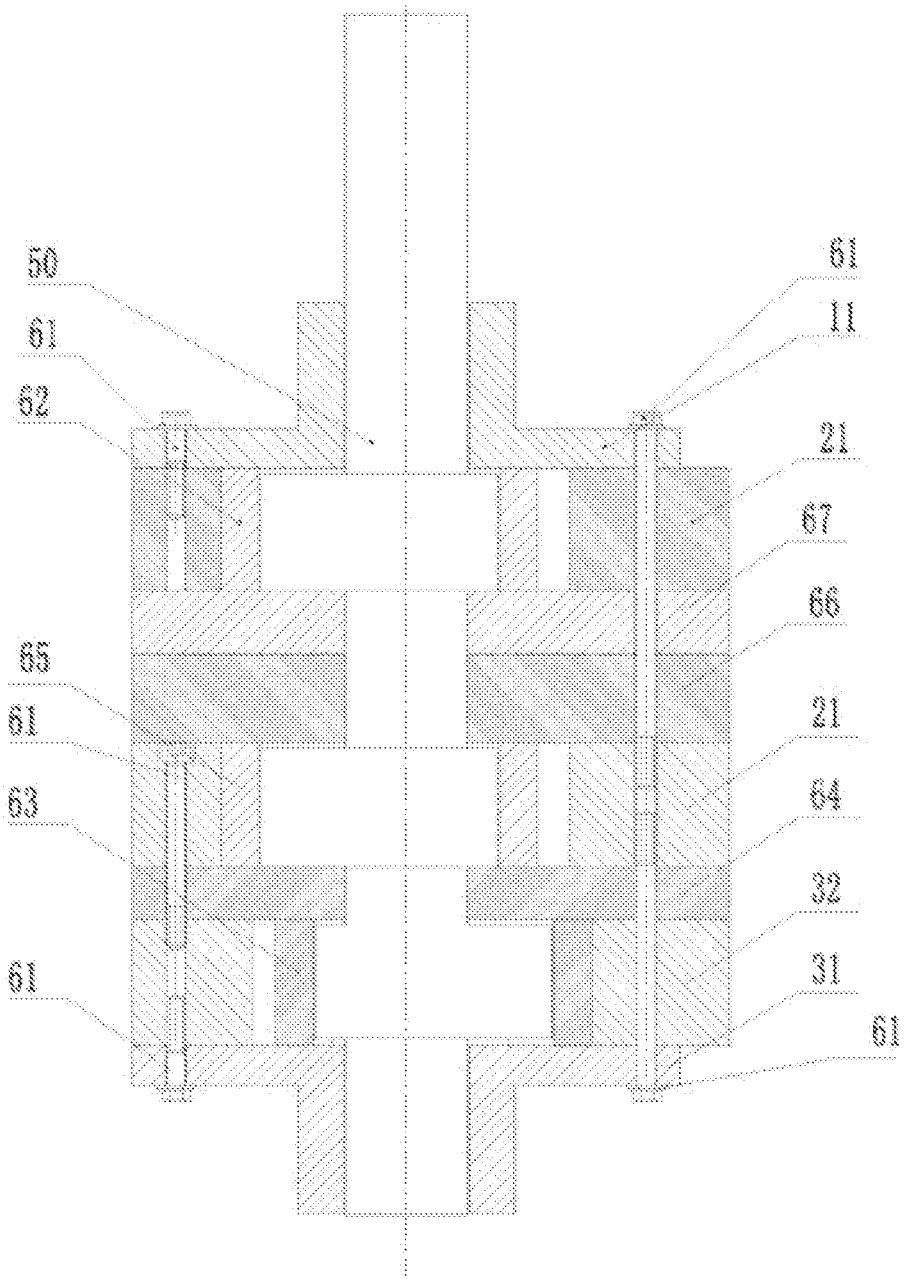
FIG. 7 shows a sectional structure diagram of an embodiment of assembling a first cylinder assembly, a second cylinder assembly and a third cylinder according to the disclosure.
Figure 8:
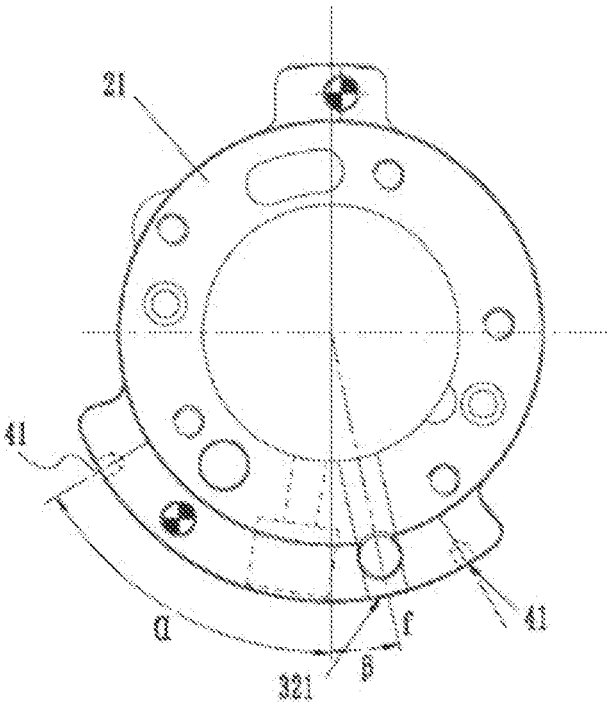
FIG. 8 shows a structure diagram of an embodiment of the second cylinder in FIG. 7.

As shown in FIG. 2, the positioning detection portion 40 includes a first detection portion 41. The third cylinder assembly 30 includes a lower flange 31, a third cylinder 32 and a lower cover plate 33. The third cylinder 32 is connected with the lower flange 31. The lower cover plate 33 is connected with the lower flange 31 and located below the lower flange 31, and the first detection portion 41 is arranged on one of the lower flange 31, the third cylinder 32, and the lower cover plate 33. The first detection portion 41 of the detection portion 40 provides a positioning basis for assembly of other pump body assemblies according to the arrangement, and all parts of the third cylinder assembly are connected into a whole, which is more convenient for further integral assembly of the pump body assembly.

Figure 9:
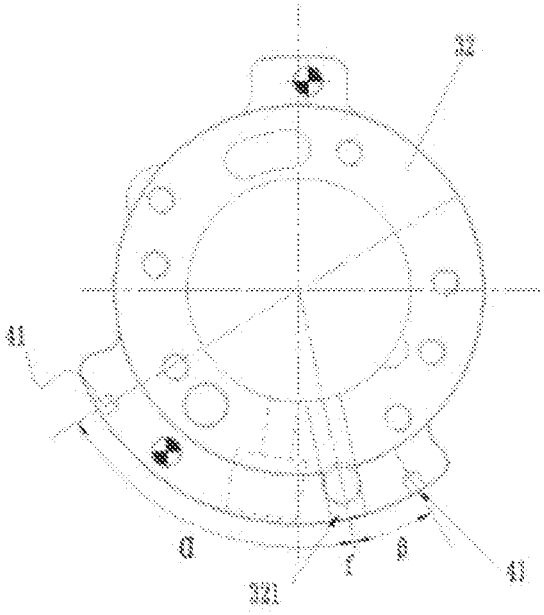
FIG. 9 shows a structure diagram of an embodiment of the third cylinder in FIG. 7.

As shown in FIG. 9, the first detection portion 41 is a positioning hole. The positioning hole is arranged in an outer peripheral surface of the third cylinder 32. The third cylinder 32 is provided with a third sliding-vane groove 321 (the first cylinder of the first cylinder assembly has a first sliding-vane groove, and the second cylinder of the second cylinder assembly has a second sliding-vane groove), and a geometric center line of the positioning hole in a radial direction of the third cylinder 32 intersects with a geometric center line of the third sliding-vane groove 321 in a radial direction of the third cylinder 32 to form a preset included angle. A center of an outer circle of the third cylinder 32 and a center line of the third sliding-vane groove 321 are conveniently used as positioning references according to the arrangement, and the positioning holes are sequentially arranged as bases, thus being simple and easy to position.

Further, two positioning holes are provided. The preset included angle includes a first included angle and a second included angle, wherein the geometric center line of one of the two positioning holes in the radial direction of the third cylinder 32 intersects with the geometric center line of the third sliding-vane groove 321 in the radial direction of the third cylinder 32 to form the first included angle, and the geometric center line of the other one of the two positioning holes in the radial direction of the third cylinder 32 intersects with the geometric center line of the third sliding-vane groove 321 in the radial direction of the third cylinder 32 to form the second included angle. A cylinder is conveniently positioned by multiple positioning holes jointly according to the arrangement, so that an assembly is assembled more accurately.

Figure 10:
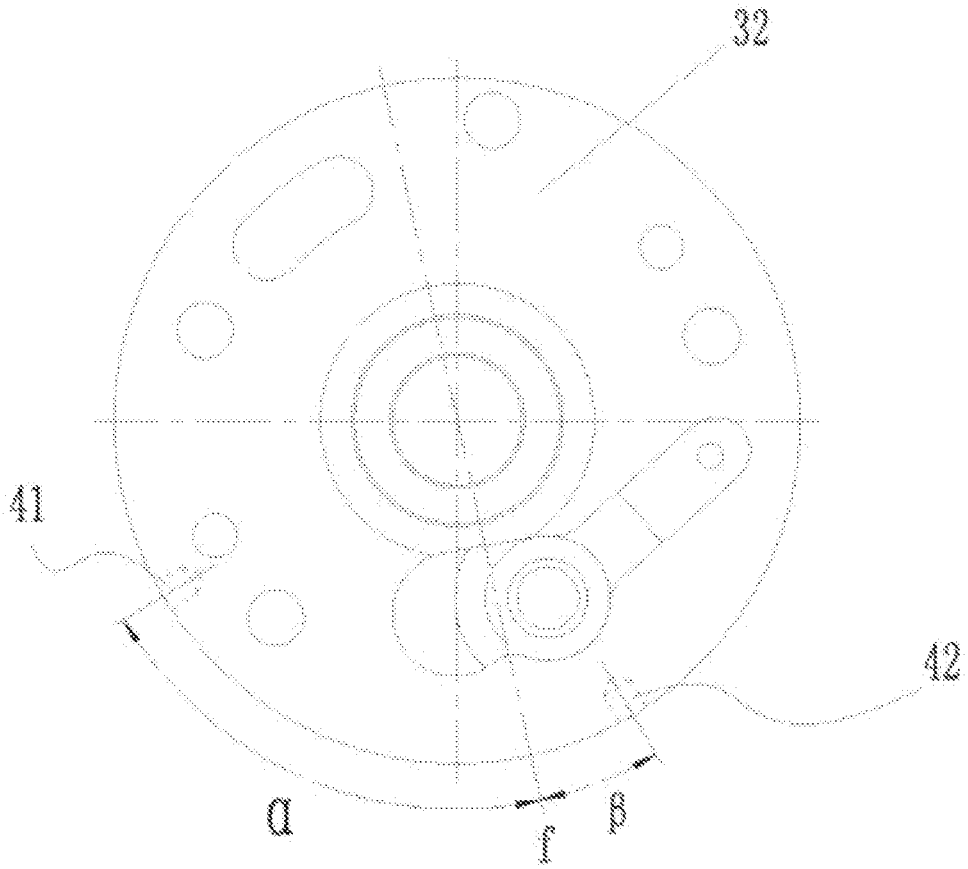
FIG. 10 shows a structure diagram of an embodiment of a lower flange in FIG. 7.

As shown in FIG. 9 and FIG. 10, the first included angle is $\alpha$, and the second included angle is $\beta$, wherein $\alpha+\beta=90°$, $0<\alpha<120°$, and $-120<\beta<90°$. The positioning holes are located on both sides of a center line formed by connecting a center of an outer circle of a cylinder and the sliding-vane groove according to the arrangement, which facilitates independent positioning of the positioning holes. In addition, a mutual included angle between the two positioning holes is set as 90°, which facilitates design of an assembly tooling and matching inspection on positioning results.

Further, a roughness of an inner circle of the positioning hole is less than or equal to 1.6. Errors in positioning detection are conveniently reduced according to the arrangement, thus ensuring that an assembly is assembled more accurately.

In this embodiment, the second cylinder assembly 20 is provided with the positioning detection portion 40. The positioning detection portion 40 further includes a second detection portion 42. The second cylinder assembly 20 includes a second cylinder 21. The second detection portion 42 is arranged on an outer peripheral surface of the second cylinder, and a projection of a geometric center line of the second detection portion 42 in a radial direction of the second cylinder 21 on a horizontal plane is overlapped with a projection of a geometric center line of the first detection portion 41 in the radial direction of the third cylinder 32 on the horizontal plane. An assembly accuracy of the second cylinder assembly 20 and the third cylinder 32 is ensured according to the arrangement.

In this embodiment, the first cylinder assembly 10 is provided with the positioning detection portion 40. The positioning detection portion 40 further includes a third detection portion 43. The first cylinder assembly 10 includes an upper flange 11 and a first cylinder 12, and the first cylinder 12 is connected with the upper flange 11 and located below the upper flange 11. The third detection portion 43 is arranged on an outer peripheral surface of the upper flange 11 or the first cylinder 12, and a projection of a geometric center line of the third detection portion 43 in a radial direction of the first cylinder 12 on a horizontal plane is overlapped with a projection of a geometric center line of the first detection portion 41 in the radial direction of the third cylinder 32 on the horizontal plane. An assembly accuracy of the first cylinder assembly 10 and the third cylinder 32 is ensured according to the arrangement.

In this embodiment, the positioning detection portion 40 includes a first detection portion 41, a second detection portion 42 and a third detection portion 43. The first detection portion 41 is arranged on an outer peripheral surface of a third cylinder 32 of the third cylinder assembly 30, the second detection portion 42 is arranged on an outer peripheral surface of a second cylinder 21 of the second cylinder assembly 20, and the third detection portion 43 is arranged on an outer peripheral surface of a first cylinder 12 of the first cylinder assembly 10. The first detection portion 41, the second detection portion 42 and the third detection portion 43 have a same structure, which facilitate detecting whether three positioning points of the first detection portion 41, the second detection portion 42 and the third detection portion 43 are arranged on one reference line, so that the three cylinder assemblies are assembled more accurately, and costs of a detection tooling are reduced.

According to the other aspect of the disclosure, there is provided a method for assembling a pump body structure, wherein the method is used for assembling the pump body assembly in the above embodiment, and includes the following three steps. In step S10, the second cylinder assembly 20 and the third cylinder assembly 30 are assembled for the first time, and first assembly positions of the second cylinder assembly 20 and the third cylinder assembly 30 are recorded through the positioning detection portions 40 arranged on the second cylinder assembly 20 and the third cylinder assembly 30. In step S20, the second cylinder assembly 20 and the third cylinder assembly 30 that are assembled are disassembled, a crankshaft 50 of the pump body assembly is assembled with the second cylinder assembly 20 and the third cylinder assembly 30 for the second time, and second assembly positions of the second cylinder assembly 20 and the third cylinder assembly 30 are recorded through the positioning detection portions 40 arranged on the second cylinder assembly 20 and the third cylinder assembly 30. In step S30, a position of the second cylinder assembly 20 is adjusted according to a relationship between the first assembly position and the second assembly position until relative positions of the second cylinder assembly 20 and the third cylinder assembly 30 fall into preset assembly positions, and the second cylinder assembly 20 and the third cylinder assembly 30 are fixed through a screw 61. In addition, a lower partition plate 64, a middle partition plate 66, a middle roller 65 and a lower roller 63 need to be installed for assembling the second cylinder assembly 20 and the third cylinder assembly 30. The second cylinder assembly 20 and the third cylinder assembly 30 are accurately positioned, and connected and fastened by a screw 61 conveniently according to the arrangement, so as to continue to accurately position and assemble with the first cylinder assembly 10.

Further, the step S10 includes determining the first assembly positions through a positioning hole arranged in the second cylinder 21 of the second cylinder assembly 20 and a positioning hole arranged in the third cylinder 32 of the third cylinder assembly 30. The step S20 includes determining the second assembly positions through a positioning hole arranged in the second cylinder 21 of the second cylinder assembly 20 and a positioning hole arranged in the third cylinder 32 of the third cylinder assembly 30. The two steps can be performed both or one of the two steps can be completed separately. Such an arrangement ensures a positioning accuracy of the second cylinder assembly 20 and the third cylinder assembly 30 is ensured according to the arrangement.

In this embodiment, the step S10 includes determining the first assembly positions through a positioning hole arranged in the second cylinder 21 of the second cylinder assembly 20 and a positioning hole arranged in the lower flange 31 of the third cylinder assembly 30. The step S20 includes determining the second assembly positions through a positioning hole arranged in the second cylinder 21 of the second cylinder assembly 20 and a positioning hole arranged in the lower flange 31 of the third cylinder assembly 30. The two steps can be performed both or one of the two steps can be completed separately. Such an arrangement ensures a positioning accuracy of the second cylinder 21 of the second cylinder assembly 20 and the lower flange 31 of the third cylinder assembly 30.

In this embodiment, the method further includes the following step S40: when the second cylinder assembly 20 and the third cylinder assembly 30 are assembled on the preset assembly positions, the first cylinder assembly 10 is assembled on the second cylinder assembly 20. In addition, an upper partition plate 67 and an upper roller 62 need to be installed for assembling the first cylinder assembly 10 and the second cylinder assembly 20. An assembly accuracy of the three cylinder assemblies is ensured according to the arrangement.

Specifically, the three-cylinder compressor pump body is mainly composed of the upper flange, the third cylinder, the upper partition plate, the middle partition plate, the first cylinder, the lower partition plate, the second cylinder, the lower flange, the crankshaft, the upper roller, the middle roller and the lower roller. Compared with the conventional compressor, the three-cylinder compressor is composed of three cylinders, including the first cylinder, the second cylinder and the third cylinder. Due to the additional third cylinder, a severe problem is caused to the pump body during assembly, and the pump body structure cannot be directly and automatically assembled when assembling the middle cylinder. The main reason is that after the lower flange and the second cylinder are assembled, the crankshaft cannot be taken out after the lower partition plate is placed, so that an eccentricity of the crankshaft and relevant dimensions of the lower flange and the first cylinder cannot be measured, and relative positions of all parts cannot be confirmed, such that the middle cylinder cannot be centered through the pump body structure. If an inner hole of the lower partition plate is enlarged to take out the crankshaft, a sealing distance is insufficient, which leads to serious operation leakage and serious performance degradation to the compressor.

In this embodiment, the relative positions of the parts are confirmed by reasonably designing a simple structure on the outer circle of the cylinder without sacrificing the performance of the compressor, thus meeting design requirements.

A connecting line between the sliding-vane groove and a center of the cylinder is used as a reference line in the second cylinder (as shown by f in the figure). A first measuring point is arranged on an outer circle with an included angle of $\alpha$ as a position measuring hole, and a second measuring point is arranged on an outer circle with an included angle of $\beta$ as a position measuring hole. The left side of the reference line is defined as a positive value, the right side of the reference line is defined as a negative value, and $\alpha+\beta=90°$ and $0<\alpha<120°$ are met. The first cylinder or the lower flange is provided with the position measuring holes at the same relative positions as the second cylinder, and the position measuring holes of the first cylinder and the second cylinder are located on a same vertical plane when the pump body assembly is completed. An accuracy of the position measuring hole shall simultaneously meet that an inner circle roughness is no more than Ra1.6.

The specific steps are as follows.

1. As shown in FIG. 1, the upper flange and the first cylinder are completely assembled by measuring an inner diameter of the upper flange, an inner diameter of the first cylinder and a relationship between eccentricities on the upper roller and the crankshaft through equipment centering. After fixing by screw, the crankshaft and the upper roller are taken out.

2. The same mode as in the step 1 is used, the relative positions of the lower flange and the second cylinder are completely determined by measuring an inner diameter of the lower flange, an inner diameter of the second cylinder and a relationship between eccentricities under the upper roller and the crankshaft through equipment centering, and the crankshaft and the lower roller are taken out after the lower flange is fixed on the second cylinder by screw.

3. Based the step 2, the lower partition plate and the second cylinder are sequentially placed according to a hole position centering relationship, and a relative position relationship between the second cylinder and the lower flange is determined by measuring the inner diameter of the lower flange, the inner diameter of the second cylinder and the relationship between the eccentricities under the upper roller and the crankshaft. Meanwhile, a relative position relationship A between the first cylinder and the second cylinder is recorded through the position measuring holes of the second cylinder.

4. The lower partition plate and the second cylinder are removed, the crankshaft and the lower roller are put into the third cylinder, and then a relative position relationship B between the first cylinder and the second cylinder is recorded through the position measuring holes of the second cylinder and the third cylinder after the lower partition plate, the third cylinder and the middle roller are placed again.

5. The relative position relationship A between the second cylinder and the third cylinder recorded in the step 3 is combined with the relative position relationship B between the first cylinder and the second cylinder in the step 4 to move the first cylinder to ensure that the relative position relationship between the first cylinder and the second cylinder in the step is consistent with the relative position relationship between the first cylinder and the second cylinder recorded in the step 3 or to ensure that the first cylinder and the second cylinder are assembled to the preset assembly positions, and the second cylinder is fixed on the third cylinder by screw to ensure the relative position relationship between the second cylinder and the third cylinder.

6. The upper partition plate is placed, the upper roller and the upper flange in the step 1 are fixed with the first cylinder assembly on the middle cylinder by screw, and the lower cylinder is further fixed on the middle cylinder to complete the pump body assembly. Meanwhile, the position measuring holes in the second cylinder can also be placed on the lower flange, and the assembly is implemented in the same way as above.

When the position measuring holes are not provided, but the first measuring point needs to be arranged on the outer circle with the included angle of $\alpha$ and the second measuring point needs to be arranged on the outer circle with the included angle of $\beta$, the left side of the reference line is defined as the positive value, the right side of the reference line is defined as the negative value, and $\alpha+\beta=90°$ and $90°<\alpha<120°$ are met. Meanwhile, the part of $\alpha$ or $\beta$ shall meet that a roughness is no more than Ra1.6.

An outer circle of a part, is conventionally designed as a rough turning surface, which can meet use requirements. Using this solution to perform fine turning or rough grinding on the outer circle of the part will increase the processing cost, but can meet the design requirements eased. This solution is a batch production solution. It can be seen from the above description that the above embodiments of the disclosure achieve the following technical effects.

The pump body assembly includes the first cylinder assembly, the second cylinder assembly and the third cylinder assembly sequentially arranged in the vertical direction, wherein at least one of the first cylinder assembly, the second cylinder assembly and the third cylinder assembly is provided with the positioning detection portion, the geometric center line of the positioning detection portion in the radial direction of the pump body assembly has the preset included angle with the extension line from the sliding-vane groove in the first cylinder assembly, the second cylinder assembly or the third cylinder assembly to the geometric center of the pump body assembly, and the preset included angle is used for positioning the first cylinder assembly, the second cylinder assembly and the third cylinder assembly to implement the automatic assembly of the pump body assembly. At least one of the three vertically arranged cylinder assemblies is provided with the positioning detection portion, and the positioning detection portion is used as a reference for determining a position relationship among all flanges and cylinders, thus providing a basis for eccentric assembly of the cylinder and ensuring a centering accuracy of an assembly method of the pump body assembly. Automatic assembly of a middle cylinder assembly of the pump body assembly is implemented by the method, so that automatic assembly of a multi-cylinder pump body assembly can be implemented, thus improving a production efficiency.

The above description is only preferred embodiments of the disclosure and is not used to limit the disclosure. Those skilled in the art can make various modifications and changes to the disclosure. All the modifications, equivalents, and improvements made within the spirit and principle of the disclosure should fall within the scope of protection of the disclosure.

What is claimed is:

1. A pump body assembly, comprising:

a first cylinder assembly (10);

a second cylinder assembly (20);

a third cylinder assembly (30);

wherein the first cylinder assembly, second cylinder assembly, and third cylinder assembly are sequentially arranged in a vertical direction;

wherein at least one of the first cylinder assembly (10), the second cylinder assembly (20) and the third cylinder assembly (30) is provided with a positioning detection portion (40);

wherein a geometric center line of the positioning detection portion (40) in a radial direction of the pump body assembly has a preset included angle with an extension line from a sliding-vane groove in the first cylinder assembly (10), the second cylinder assembly (20) or the third cylinder assembly (30) to a geometric center of the pump body assembly; and wherein the preset included angle is used for positioning the first cylinder assembly (10), the second cylinder assembly (20) and the third cylinder assembly (30) to implement assembly of the pump body assembly.

2. The pump body assembly according to claim 1, wherein the positioning detection portion (40) comprises a first detection portion (41), the third cylinder assembly (30) comprises a lower flange (31); a third cylinder (32), the third cylinder (32) being connected with the lower flange (31); and a lower cover plate (33), the lower cover plate (33) being connected with the lower flange (31) and located below the lower flange (31); and the first detection portion (41) is arranged on one of the lower flange (31), the third cylinder (32) and the lower cover plate (33).

3. The pump body assembly according to claim 2, wherein the first detection portion (41) is a positioning hole, the positioning hole is arranged in an outer peripheral surface of the third cylinder (32), the third cylinder (32) is provided with a third sliding-vane groove (321), and a geometric center line of the positioning hole in a radial direction of the third cylinder (32) intersects with a geometric center line of the third sliding-vane groove (321) in a radial direction of the third cylinder (32) to form a preset included angle.

4. The pump body assembly according to claim 1, wherein the positioning detection portion (40) comprises a first detection portion (41), a second detection portion (42) and a third detection portion (43), the first detection portion (41) is arranged on an outer peripheral surface of a third cylinder (32) of the third cylinder assembly (30), the second detection portion (42) is arranged on an outer peripheral surface of a second cylinder (21) of the second cylinder assembly (20), the third detection portion (43) is arranged on an outer peripheral surface of a first cylinder (12) of the first cylinder assembly (10), and the first detection portion (41), the second detection portion (42) and the third detection portion (43) have a same structure.

5. A pump body assembly, comprising:

a first cylinder assembly (10);

a second cylinder assembly (20);

a third cylinder assembly (30);

wherein the first cylinder assembly, second cylinder assembly, and third cylinder assembly are sequentially arranged in a vertical direction;

wherein at least one of the first cylinder assembly (10), the second cylinder assembly (20) and the third cylinder assembly (30) is provided with a positioning detection portion (40);

wherein a geometric center line of the positioning detection portion (40) in a radial direction of the pump body assembly has a preset included angle with an extension line from a sliding-vane groove in the first cylinder assembly (10), the second cylinder assembly (20) or the third cylinder assembly (30) to a geometric center of the pump body assembly;

wherein the positioning detection portion (40) comprises a first detection portion (41), the third cylinder assembly (30) comprises a lower flange (31); a third cylinder (32), the third cylinder (32) being connected with the lower flange (31); and a lower cover plate (33), the lower cover plate (33) being connected with the lower flange (31) and located below the lower flange (31); and the first detection portion (41) is arranged on one of the lower flange (31), the third cylinder (32) and the lower cover plate (33);

wherein the first detection portion (41) is a positioning hole, the positioning hole is arranged in an outer peripheral surface of the third cylinder (32), the third cylinder (32) is provided with a third sliding-vane groove (321), and a geometric center line of the positioning hole in a radial direction of the third cylinder (32) intersects with a geometric center line of the third sliding-vane groove (321) in a radial direction of the third cylinder (32) to form a preset included angle;

wherein the preset included angle is used for positioning the first cylinder assembly (10), the second cylinder assembly (20) and the third cylinder assembly (30) to implement assembly of the pump body assembly; and wherein two positioning holes are provided, and the preset included angle comprises a first included angle and a second included angle, wherein the geometric center line of one of the two positioning holes in the radial direction of the third cylinder (32) intersects with the geometric center line of the third sliding-vane groove (321) in the radial direction of the third cylinder (32) to form the first included angle, and the geometric center line of the other one of the two positioning holes in the radial direction of the third cylinder (32) intersects with the geometric center line of the third sliding-vane groove (321) in the radial direction of the third cylinder (32) to form the second included angle.

6. The pump body assembly according to claim 5, wherein the first included angle is $\alpha$, and the second included angle is $\beta$, wherein $\alpha+\beta=90°$, $0<\alpha<120°$, and $-120<\beta<90°$.

7. The pump body assembly according to claim 5, wherein a roughness of an inner circle of the positioning hole is less than or equal to 1.6.

8. A pump body assembly, comprising:

a first cylinder assembly (10);

a second cylinder assembly (20);

a third cylinder assembly (30);

wherein the first cylinder assembly, second cylinder assembly, and third cylinder assembly are sequentially arranged in a vertical direction;

wherein at least one of the first cylinder assembly (10), the second cylinder assembly (20) and the third cylinder assembly (30) is provided with a positioning detection portion (40);

wherein a geometric center line of the positioning detection portion (40) in a radial direction of the pump body assembly has a preset included angle with an extension line from a sliding-vane groove in the first cylinder assembly (10), the second cylinder assembly (20) or the third cylinder assembly (30) to a geometric center of the pump body assembly;

wherein the positioning detection portion (40) comprises a first detection portion (41), the third cylinder assembly (30) comprises a lower flange (31); a third cylinder (32), the third cylinder (32) being connected with the lower flange (31); and a lower cover plate (33), the lower cover plate (33) being connected with the lower flange (31) and located below the lower flange (31); and the first detection portion (41) is arranged on one of the lower flange (31), the third cylinder (32) and the lower cover plate (33);

wherein the first detection portion (41) is a positioning hole, the positioning hole is arranged in an outer peripheral surface of the third cylinder (32), the third cylinder (32) is provided with a third sliding-vane groove (321), and a geometric center line of the positioning hole in a radial direction of the third cylinder (32) intersects with a geometric center line of the third sliding-vane groove (321) in a radial direction of the third cylinder (32) to form a preset included angle;

wherein the preset included angle is used for positioning the first cylinder assembly (10), the second cylinder assembly (20) and the third cylinder assembly (30) to implement assembly of the pump body assembly; and wherein the second cylinder assembly (20) is provided with the positioning detection portion (40), the positioning detection portion (40) further comprises a second detection portion (42), the second cylinder assembly (20) comprises a second cylinder (21), the second detection portion (42) is arranged on an outer peripheral surface of the second cylinder, and a projection of a geometric center line of the second detection portion (42) in a radial direction of the second cylinder (21) on a horizontal plane is overlapped with a projection of a geometric center line of the first detection portion (41) in the radial direction of the third cylinder (32) on the horizontal plane.

9. A pump body assembly, comprising:

a first cylinder assembly (10);

a second cylinder assembly (20);

a third cylinder assembly (30);

wherein the first cylinder assembly, second cylinder assembly, and third cylinder assembly are sequentially arranged in a vertical direction;

wherein at least one of the first cylinder assembly (10), the second cylinder assembly (20) and the third cylinder assembly (30) is provided with a positioning detection portion (40);

wherein a geometric center line of the positioning detection portion (40) in a radial direction of the pump body assembly has a preset included angle with an extension line from a sliding-vane groove in the first cylinder assembly (10), the second cylinder assembly (20) or the third cylinder assembly (30) to a geometric center of the pump body assembly;

wherein the positioning detection portion (40) comprises a first detection portion (41), the third cylinder assembly (30) comprises a lower flange (31); a third cylinder (32), the third cylinder (32) being connected with the lower flange (31); and a lower cover plate (33), the lower cover plate (33) being connected with the lower flange (31) and located below the lower flange (31); and the first detection portion (41) is arranged on one of the lower flange (31), the third cylinder (32) and the lower cover plate (33);

wherein the first detection portion (41) is a positioning hole, the positioning hole is arranged in an outer peripheral surface of the third cylinder (32), the third cylinder (32) is provided with a third sliding-vane groove (321), and a geometric center line of the positioning hole in a radial direction of the third cylinder (32) intersects with a geometric center line of the third sliding-vane groove (321) in a radial direction of the third cylinder (32) to form a preset included angle;

wherein the preset included angle is used for positioning the first cylinder assembly (10), the second cylinder assembly (20) and the third cylinder assembly (30) to implement assembly of the pump body assembly; and wherein the first cylinder assembly (10) is provided with the positioning detection portion (40), the positioning detection portion (40) further comprises a third detection portion (43), the first cylinder assembly (10) comprises an upper flange (11); and a first cylinder (12), the first cylinder (12) being connected with the upper flange (11) and located below the upper flange (11); the third detection portion (43) is arranged on an outer peripheral surface of the upper flange (11) or the first cylinder (12), and a projection of a geometric center line of the third detection portion (43) in a radial direction of the first cylinder (12) on a horizontal plane is overlapped with a projection of a geometric center line of the first detection portion (41) in the radial direction of the third cylinder (32) on the horizontal plane.

10. A method for assembling a pump body assembly comprising:

a first cylinder assembly (10);

a second cylinder assembly (20);

a third cylinder assembly (30);

wherein the first cylinder assembly, second cylinder assembly, and third cylinder assembly are sequentially arranged in a vertical direction;

wherein at least one of the first cylinder assembly (10), the second cylinder assembly (20) and the third cylinder assembly (30) comprises a positioning detection portion (40);

wherein a geometric center line of the positioning detection portion (40) in a radial direction of the pump body assembly has a preset included angle with an extension line from a sliding-vane groove in the first cylinder assembly (10), the second cylinder assembly (20) or the third cylinder assembly (30) to a geometric center of the pump body assembly; and wherein the preset included angle is used for positioning the first cylinder assembly (10), the second cylinder assembly (20) and the third cylinder assembly (30) to implement assembly of the pump body assembly;

assembling the second cylinder assembly (20) and the third cylinder assembly (30) for the first time;

recording first assembly positions of the second cylinder assembly (20) and the third cylinder assembly (30) through the positioning detection portions (40) arranged on the second cylinder assembly (20) and the third cylinder assembly (30);

disassembling the second cylinder assembly (20) and the third cylinder assembly (30) that are assembled;

assembling a crankshaft (50) of the pump body assembly with the second cylinder assembly (20) and the third cylinder assembly (30) for the second time;

recording second assembly positions of the second cylinder assembly (20) and the third cylinder assembly (30) through the positioning detection portions (40) arranged on the second cylinder assembly (20) and the third cylinder assembly (30);

adjusting a position of the second cylinder assembly (20) according to a relationship between the first assembly position and the second assembly position until relative positions of the second cylinder assembly (20) and the third cylinder assembly (30) fall into preset assembly positions; and fixing the second cylinder assembly (20) and the third cylinder assembly (30) through a screw (61).

11. The method for assembling the pump body structure according to claim 10, further comprising:

determining the first assembly positions through a positioning hole arranged in the second cylinder (21) of the second cylinder assembly (20) and a positioning hole arranged in the third cylinder (32) of the third cylinder assembly (30); and/or determining the second assembly positions through a positioning hole arranged in the second cylinder (21) of the second cylinder assembly (20) and a positioning hole arranged in the third cylinder (32) of the third cylinder assembly (30).

12. The method for assembling the pump body structure according to claim 10, further comprising:

determining the first assembly positions through a positioning hole arranged in the second cylinder (21) of the second cylinder assembly (20) and a positioning hole arranged in the lower flange (31) of the third cylinder assembly (30); and/or determining the second assembly positions through a positioning hole arranged in the second cylinder (21) of the second cylinder assembly (20) and a positioning hole arranged in the lower flange (31) of the third cylinder assembly (30).

13. The method for assembling the pump body structure according to claim 10, wherein the method further comprises: when assembling the second cylinder assembly (20) and the third cylinder assembly (30) on the preset assembly positions, assembling the first cylinder assembly (10) on the second cylinder assembly (20).

* * * * *